United States Patent [19]

LaBianca et al.

[11] Patent Number: 4,733,773

[45] Date of Patent: Mar. 29, 1988

[54] AMMUNITION CONTAINER SYSTEM

[75] Inventors: Vincent S. LaBianca, Cranston; Richard Anterni, Barrington, both of R.I.

[73] Assignee: Dart Industries Inc., Deerfield, Ill.

[21] Appl. No.: 880,434

[22] Filed: Jun. 30, 1986

[51] Int. Cl.[4] ..... B65D 81/00

[52] U.S. Cl. ..... 206/3; 89/34; 206/446; 206/459; 206/509; 220/82 R

[58] Field of Search ..... 89/34; 102/282; 206/3, 206/317-320, 443, 446, 509, 825, 459; 220/91 R, 94 R, 82 R; 211/60.1

[56] References Cited

U.S. PATENT DOCUMENTS

| | | | |
|---|---|---|---|
| 2,409,748 | 10/1946 | Folst . | |
| 3,294,225 | 12/1966 | Kenyon . | |
| 3,341,063 | 9/1967 | Voorhees, Jr. . | |
| 3,446,394 | 5/1969 | Miller et al. . | |
| 3,631,969 | 1/1972 | Lacoste | 206/3 |
| 3,682,352 | 8/1972 | Doucette | 220/94 R |
| 4,140,257 | 2/1979 | Peterson . | |
| 4,179,040 | 12/1979 | Bateman et al. . | |
| 4,279,339 | 7/1981 | Gotter | 206/3 |
| 4,356,931 | 11/1982 | Schinke . | |
| 4,357,042 | 11/1982 | Gall . | |
| 4,365,722 | 12/1982 | Kramer . | |
| 4,446,979 | 5/1984 | Gach et al. . | |
| 4,489,834 | 12/1984 | Thackrey . | |
| 4,496,270 | 1/1985 | Miller . | |
| 4,500,005 | 2/1919 | Forrester . | |

FOREIGN PATENT DOCUMENTS

| | | | |
|---|---|---|---|
| 1058507 | 3/1954 | France | 206/3 |
| 0476284 | 9/1969 | Switzerland | 89/34 |

*Primary Examiner*—Jimmy G. Foster

*Attorney, Agent, or Firm*—Russell L. McIlwain

[57] ABSTRACT

A container system for shells comprising an elongate tubular housing defining a chamber having an open end and a closed end with a projectile-receiving seat at the closed end. A projectile carrier encircles the base portion of a container-received projectile and extends forwardly therefrom through a projectile-surrounding support. The chamber, immediately outward of the projectile, receives a projectile case with the open end of the case inwardly directed and closed by a removable plug which presents a rearwardly opening configuration receiving the ogive of the projectile. The container system, at the open discharge end of the housing, includes a carrier surrounding the case base. All of the components are closed within the chamber by a screw cap which in turn incorporates one or more viewing windows displaying indicia designating the nature of the contents of the container. The cap indicia is varied by rotation of an indicia ring accessible only from the interior of the cap prior to a mounting of the cap. The housing is provided with longitudinally spaced stacking blocks presenting planar edge surfaces with interlocking lugs and recesses. Reinforcing ribs are also integrally molded longitudinally along the length of the housing.

30 Claims, 17 Drawing Figures

AMMUNITION CONTAINER SYSTEM

BACKGROUND OF THE INVENTION

The invention broadly relates to ammunition container systems, and is more particularly concerned with systems for the storage of shells such as 105 mm Howitzer cartridges and the like.

Such storage systems are broadly known and generally comprise elongate containers for the reception of individual or multiple shells. The containers are normally specifically configured to enclose and protect the shells while allowing for selective ready access thereto.

Examples of known shell or cartridge supports, containers, and the like will be noted in the following patents:

D.F. Shepard U.S. Pat. No. 2,339,298
E.F. Hulbert U.S. Pat. No. 2,375,993
J.A. Burke et al U.S. Pat. No. 2,722,307
Tenney et al U.S. Pat. No. 3,939,967
Kataczynski U.S. Pat. No. 4,566,588

As will be seen in the more recent of the above patents, the increasing necessity to provide for effective long range storage of cartridges in a secure manner has led to the use of various forms of plastic containers which receive and retain the cartridges and which are adapted for stacking or otherwise grouping to facilitate both handling and storage.

The elongate nature of cartridge storage containers gives rise to the inherent problem of effectively extracting the cartridge from the container with solutions varying from a physical dumping of the cartridge from the container to the use of an elongate chord or extractor rod, as in the above Burke et al patent, which is used to draw the ammunition from the container.

SUMMARY OF THE INVENTION

The cartridge storage system of the present invention is particularly intended to provide a superior storage means including a container which, with a lightweight and economical construction, forms a high strength protective enclosure for individually positioned but disassembled projectile and case components of a cartridge.

The container is provided with an internal support system which stabilizes the components therein with the components linearly aligned within a cylindrical chamber formed to allow access to the components from a single end of the container.

It is also proposed that the storage container system be so constructed whereby the containers are specifically adapted to be palletized, that is stacked with multiple similar containers on a pallet or the like.

In conjunction with the provision of means for facilitating removal of the cartridge components from the container, it is also proposed that specific provision be made for the handling of the removed components and the transport of the components to the point of actual use in a secure and expeditious manner.

Other advantages residing in the specifics of the invention include a container system which can be adapted to accommodate different cartridges and which includes means for the provision of information as to the particulars of the contents of the container.

Basically, the objects of the invention are achieved by a shell container system which includes an elongate molded cylindrical body or housing, preferably of high density polyethylene, provided with a smooth internal bore, a closed end and an open end selectively sealed by a hand manipulable cap. The container is externally reinforced by longitudinally extending integrally molded ribs or flanges.

Further stability is introduced into the container by a series of square stacking blocks integrally molded about the basic cylindrical body of the container at spaced positions therealong, the blocks presenting planar bottom faces with sockets defined therein for the stacking reception of mating upwardly projecting lugs on planar faces of subjacent containers.

The removable end cap of the container includes enlarged gripping lugs for facilitating manipulation thereof. In addition, the container includes forwardly directed viewing windows and an internal adjustable indicia ring which is adjusted prior to a mounting of the cap to display shell-identifying information through one or more of the cap windows. Once the cap is mounted, the indicia ring is protected against change. In order to preclude tampering, provision is made for a tamper-evident mounting of the cap through the use of apertured lugs on the cap which receive a seal wire therethrough and through apertures on the container body, the wire subsequently being secured with an appropriate non-releasing seal of lead, plastic, or the like.

The base of the projectile is received at the closed end of the container and is encircled by the projectile carrier which includes a pair of elongate side straps extending forwardly within the container to a point well forward of the leading end or ogive of the projectile. The ogive of the projectile is received through and stabilized by an annular support which in turn receives the straps of the projectile carrier therethrough, thereby providing for an effective engagement of the opposed ends of the elongate projectile by the projectile carrier. This is desirable in allowing for a smooth withdrawal of the projectile from the carrier, and, significantly, in providing a means for easily carrying the withdrawn projectile, or for that matter several projectiles, with the projectiles stably held by individual carriers.

The shell case is received within the container with the base of the case at the cap end of the container. The open mouth of the case is closed by a frictionally retained shell or case plug which interfits with the projectile support. The removable plug includes a central recess which receives the projectile ogive and defines a protective enclosure recessed within the open end of the case. The plug includes gripping flanges which facilitate removal thereof, even under adverse conditions such as with hand-enclosing mittens. Thus, the charge within the case, normally provided in separate powder bags, can be easily manually changed at the actual time of use. The ready removal of the plug, which in during storage protects the charge, also facilitates immediate assembly of the projectile to the case.

Actual removal of the case from the container, and the handling of the case once removed, is accomplished by a case carrier comprising an annular ring engaged beneath the base of the case and a handle formed of a pair of flexible bales which, when stored within the container, closely overlie the ring, and, in use, are outwardly pivoted to combine and form the handle.

Other features and advantages of the invention will become apparent from the following detailed description of the construction and manner of use of the invention.

DESCRIPTION OF PREFERRED EMBODIMENT

Figure 1:
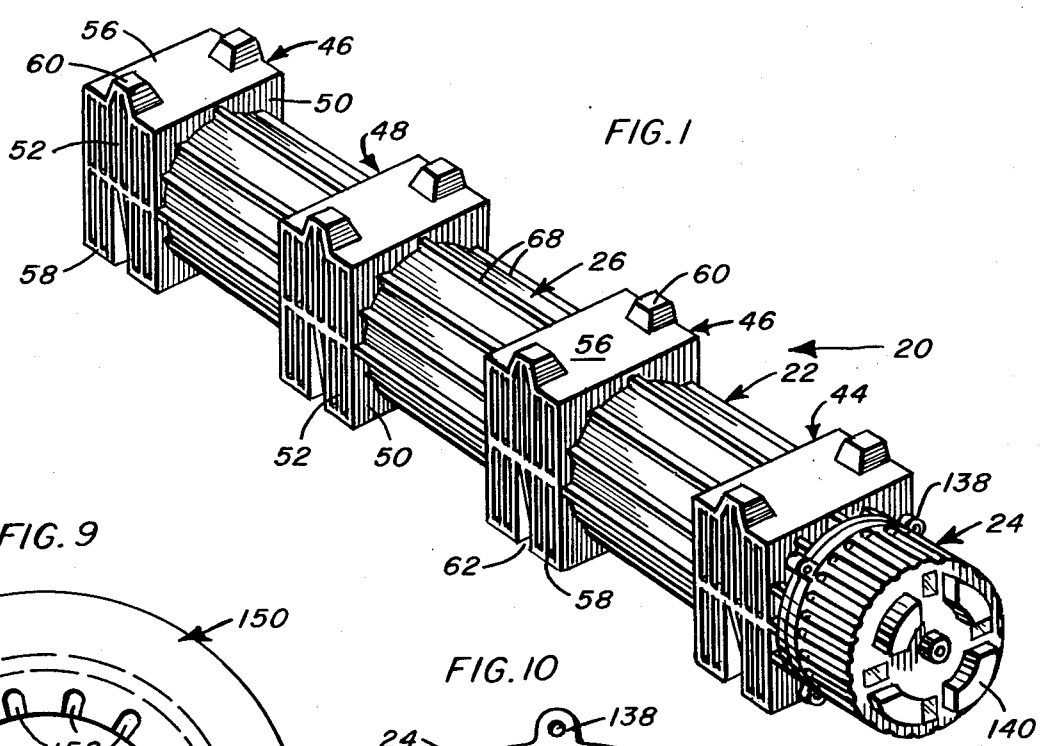
FIG. 1 is a perspective view of the container comprising the present invention.
Figure 10:
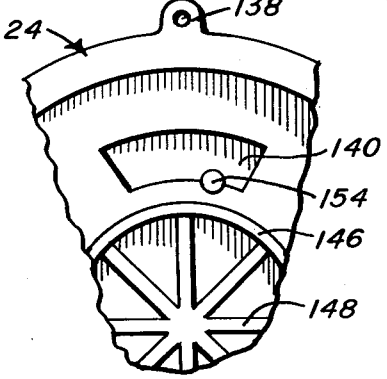
FIG. 10 is a partial plan view of the cap seen from the rear end thereof and with the indicia ring and retaining rings removed.
Figure 9:
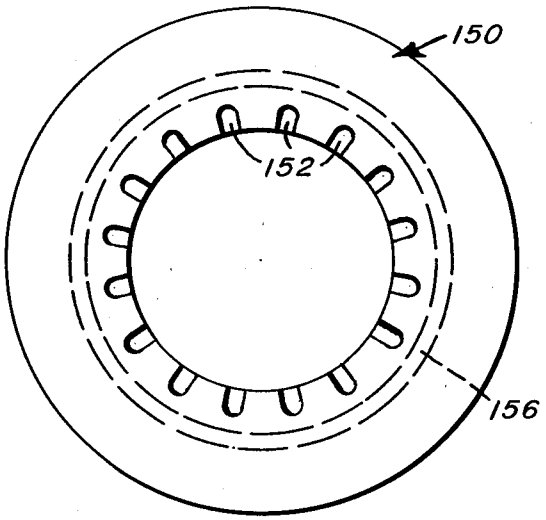
FIG. 9 is a plan view of the information or indicia bearing face of the indicia ring (indicia not shown)

Referring now more specifically to the drawings, the container of the present invention is designated by reference numeral 20. The container 20 consists basically of an elongate container housing 22 and a container cap 24.

The container housing 22 includes an elongated tubular body 26 defining a smooth or constant diameter internal bore or chamber 28 opening forwardly through a first end 30 of the housing 22 and having an inner end, at the second or rear end of the housing 22, closed by an integral end wall 32. As noted in the cross-sectional views of FIGS. 3 and 4, the internal peripheral side wall of the bore 28 can be provided with integrally formed, peripherally spaced webs 34 defining an inwardly projecting annular seat immediately adjacent the inner end wall 32 for a centralized reception and stabilization of the base end of a housing-received projectile 36.

The forward or open end 30 of the tubular body 26 is externally threaded for the threaded engagement of the container cap 24 thereover. The inner end of the threaded portion or neck 38 of the tubular body 26 terminates at an annular planar cap seating disc or plate 40 of equal diameter with the cap 24. Immediately forward of the disc 40 is an annular groove for receiving an O-ring 42 for a sealing of the cap as it seats against the disc 40.

Figure 11:
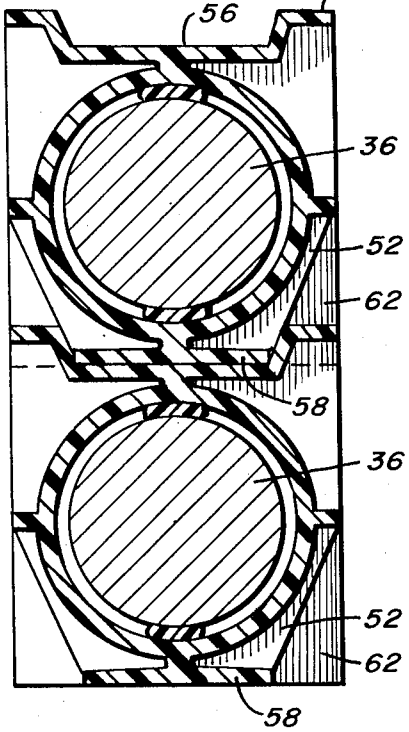
FIG. 11 is a cross-sectional detail through a pair of stacked containers.
Figure 2:
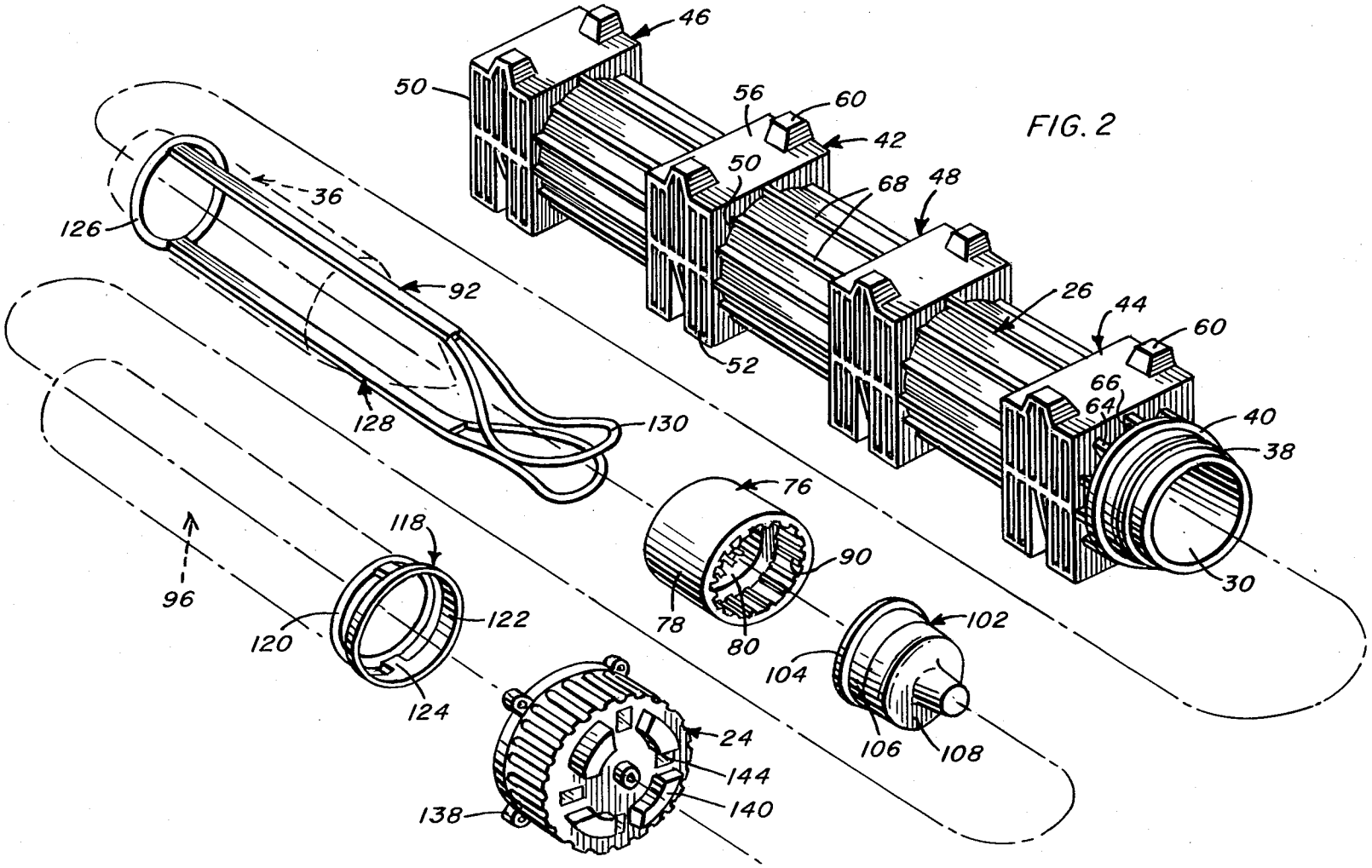
FIG. 2 is an exploded perspective view of the components comprising the container system of the invention.

Immediately rearward of the cap seating disc 40 is a square stacking block 44 integrally molded with and about the tubular body 26. A similar block 46 is provided integrally about the rear of the tubular body 26 with two additional similar blocks 48 provided at equally spaced points along the length of the body 26. Each of the stacking blocks includes a pair of outer walls 50 and multiple inner walls 52 positioned in closely spaced parallel planes. The walls 50 and 52 are, in each stacking block, interconnected by a plurality of transverse webs 54 molded therebetween peripherally about the tubular body 26. In addition, each block 44, 46 and 48, includes a planar top wall 56 and a planar bottom wall 58 defining flat stacking surfaces interrupted solely by a pair of integrally molded vertically projecting lugs 60 on each top wall 56 and lug receiving recesses 62 in the bottom walls 58. It is specifically intended that the projecting lugs 60 be upwardly directed from the upper walls 56 whereby the corresponding bottom walls 62 can be maintained planar for positioning on pallets and the like. Particular attention is directed to FIG. 11 for the proposed stacking arrangement of the containers. It will also be appreciated that the outer and inner walls 50 and 52 of the stacking blocks are of equal size and present smooth side faces for compact abutment against the blocks of adjoining containers within a stack. The utilization of spaced walls, interconnected by rigidifying webs 54, is particularly significant in providing for substantial strength with minimal additional weight.

It will be noted that reinforcing webs 64 are provided between the forwardmost outer wall 50 of the front stack 44 and the cap seating disc 40. These webs 64, or selected ones thereof, are provided with apertures 66 therethrough for reasons which shall be set forth subsequently.

Further rigidity is achieved for the container by the provision of integral longitudinally extending ribs or flanges 68 molded along the length of the tubular body 26 between the stacking blocks and at peripherally spaced points about the tubular body. As will be appreciated, these ribs, while extending radially outward from the tubular body 26, stop short of the outer square periphery of the stacking blocks to avoid such projections as may interfere with the stacking or palletizing of multiple containers.

In order to additionally rigidify the inner or rear end wall 32 of the container 22, multiple reinforcing ribs 70 can be molded on the exterior surface thereof and within a central recess defined in the rearmost outer wall 50 of the rear stacking block 46, the rear edges of the ribs 70 being coplanar with the rear face of this rear wall 50 to present a planar surface which will provide a stable base for a vertical positioning of the container should such be desired.

With the base end 72 of the projectile 36 received within the seat 34 at the rear of the housing chamber 28, the tapered forward portion 74 of the projectile is received through and stabilized by an annular projectile support 76. The support 76 is in the nature of a slightly elongate cylinder having a smooth outer wall 78 slidably receivable within the housing chamber 28 in close conformity thereto.

A shoulder 80 is provided at approximately mid-height within the support 76 with an annular inner wall 82 extending from the inner periphery of the shoulder 80 between the shoulder 80 and the rear end of the support 76 coaxial with the outer wall 78. The coaxial walls 78 and 82 define an annular space divided into multiple chambers by radially extending reinforcing webs 84. Immediately inward of the wall 82 is an integral tapered seat 86 extending forwardly and inwardly from a rear annular edge integral with the rear edge of the wall 82 and terminating slightly rearward of the shoulder 80. This tapered seat 86 is configured to conform to the tapered leading end portion 74 of the projectile 36 and is generally in the nature of a truncated conical wall. The seat 86 may be rigidified by peripherally spaced radial webs 88.

The projectile support 76 is further strengthened by peripherally spaced longitudinally extending ribs 90 extending longitudinally from the shoulder 80 to the forward edge of the support 76.

The support 76, preferably of high density polyethylene, is an integrally formed rigid element providing maximum strength and stability, as well as projectile support, with minimal material and weight. While it is particularly important that the support 76 assist in stabilizing the leading portion of the projectile within the container during transport and storage, another highly significant feature of the support is to function as means for stabilizing the projectile within the carrier 92 (to be described subsequently) both as the projectile is withdrawn from the container and as the projectile is carried to the point of use.

In order to accommodate the carrier 92, the projectile support 76 is provided with a pair of diametrically opposed passages 94 defined along the inner surface of the outer wall 78 of the support 76. These passages 94, between the shoulder 80 and the rear end of the support 76, are defined by a peripherally closed passage wall opening both forwardly through the shoulder 80 and rearwardly through the rear end of the support 76. The adjoining portion of the inner surface of the outer wall 78 of the support 76 defines a portion of the passage wall and a smooth continuation thereof forwardly toward the forward end of the support 76. As illustrated, the longitudinally extending reinforcing ribs 90 will be peripherally spaced to each side of the passage 94 to allow for unencumbered positioning of carrier portions through the passages 94.

The shell or case 96 for the projectile 36 is longitudinally aligned with the projectile within the container chamber 28 forward of the projectile. The base 98 of the case 96 is positioned forwardly at, and in fact immediately beyond, the open end 30 of the tubular housing 26 with the open end or mouth 100 of the case 96 rearwardly directed in the chamber and slidably engaging the inner edges of the reinforcing ribs 90 and seating on the shoulder 80 to enclose the ogive of the projectile 36, both reducing the required length of the container and providing additional protection for the projectile.

The open end 100 of the case 96 is provided with a removable case plug 102. The case plug 102 is hollow and is frictionally received within the open end 100 of the case 96, opening outwardly thereof. An annular outwardly directed positioning flange 104 engages the annular edge of the case 96 to define the innermost position of the plug 102. The flange 104 in turn seats directly on the support shoulder 80. The main body of the plug !02 includes an annular wall or skirt 106 projecting cylindrically forward from the positioning flange 104 and, at approximately mid-height, tapering slightly inwardly as a means for facilitating introduction into the end portion 100 of the case 96. The forward or inner end of the plug 102 is closed by a front wall 108 provided with an axial projecting compartment 110 which receives the tip of the forward portion 74 of the projectile 36.

The tip portion of the projectile 36 will actually engage within and be further cushioned by a pair of rearwardly directed arcuate finger grips 112 integral with the front wall 110 of the plug to each side of the forward compartment 110. Each of the opposed finger grips 112 includes an enlarged central recess 114 to facilitate hand engagement therewith for selective removal of the plug 102 as shall be explained subsequently. The plug is rigidified by a plurality of peripherally spaced internal webs or gussets 116 extending between the cylindrical wall 106 and the end wall 108 outward of the central finger grips 112.

A case carrier 118 of flexibly resilient material is removably engaged with the case 96 for the selective removal thereof from the chamber 28. The carrier 118 comprises a ring or collar 120 which engages behind the annularly projecting rim of the case head 98, and an annular handle 122 overlying the collar 120 in outwardly spaced parallel relation thereto. The annular handle 122 is integrally formed with the collar 120 through a diametrically opposed pair of connectors or joinder elements 124.

Figure 3:
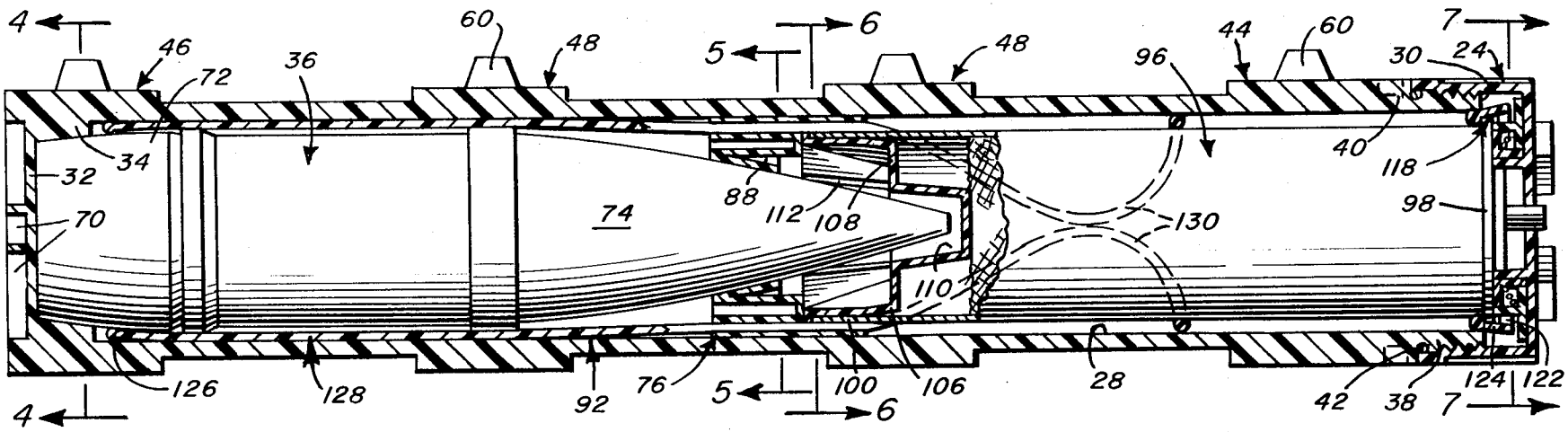
FIG. 3 is a longitudinal cross-sectional view through the container system of the invention, with a projectile and case shown therein in elevation and partially in section.
Figure 7:
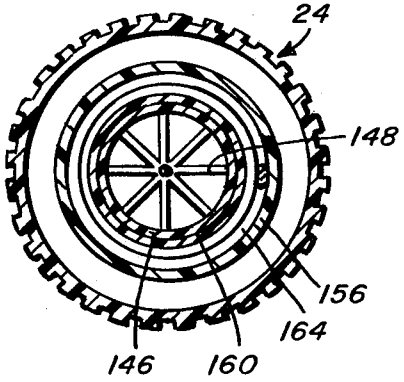
FIG. 7 is a cross-sectional view taken substantially on a plane passing along line 7—7 in FIG. 3.
Figure 6:
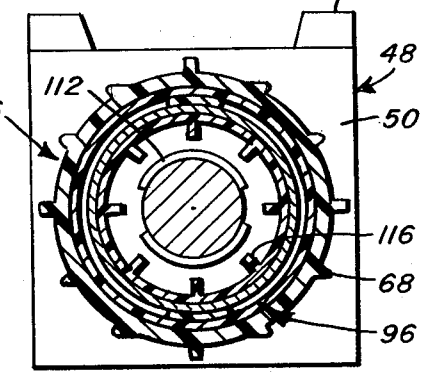
FIG. 6 is a cross-sectional view taken substantially on a plane passing along line 6—6 in FIG. 3.
Figure 5:
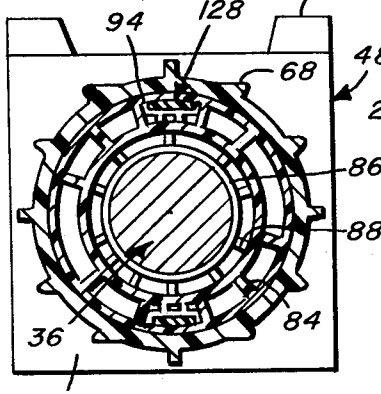
FIG. 5 is a cross-sectional view taken substantially on a plane taken along line 5—5 in FIG. 3.
Figure 4:
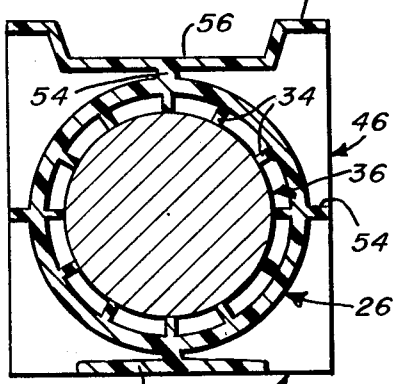
FIG. 4 is a cross-sectional view taken substantially on a plane passing along line 4—4 in FIG. 3.
Figure 8:
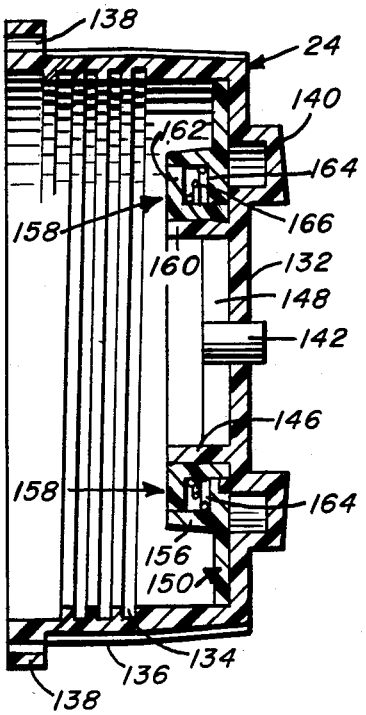
FIG. 8 is an enlarged cross-sectional view of the container cap.
Figure 12:
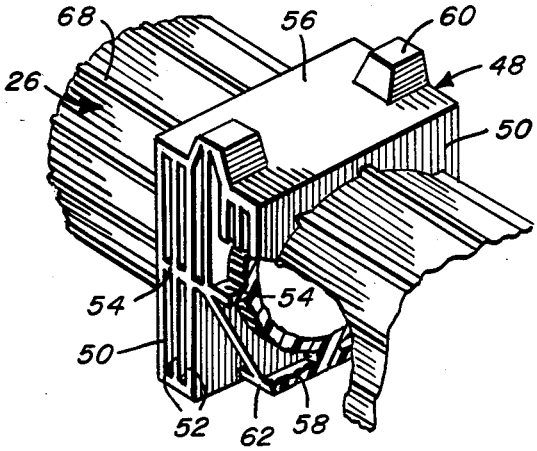
FIG. 12 is a cross-sectional detail of a portion of the container at one of the stacking blocks with portions removed for purposes of illustration.
Figure 13:
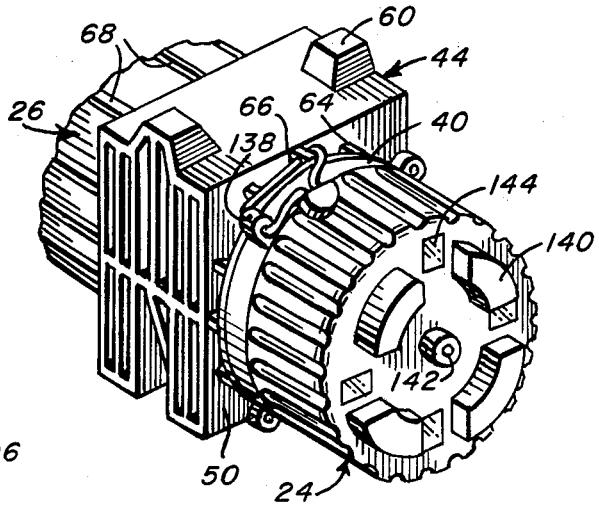
FIG. 13 is a partial perspective view of the cap end of the container with a tamper-evidence seal securing the cap.
Figure 14:
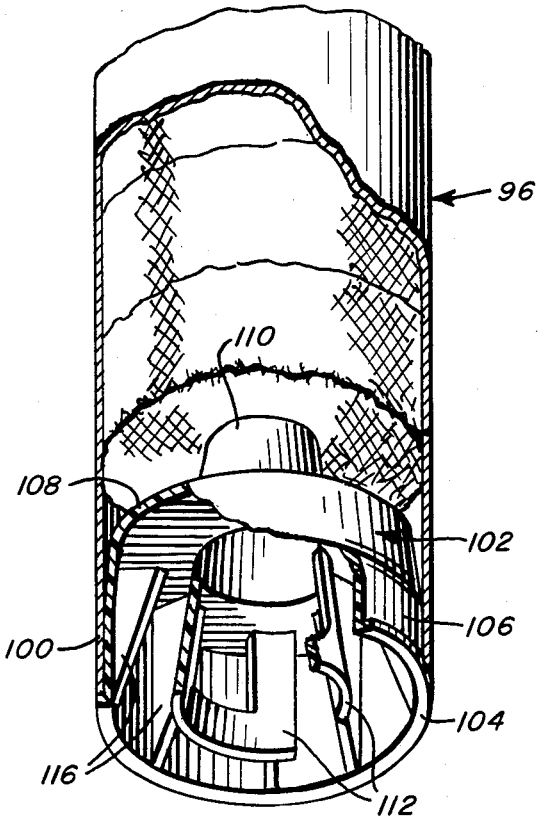
FIG. 14 is a perspective view of the base end of a cartridge case partially broken away to illustrate a case received plug and details thereof.
Figure 15:
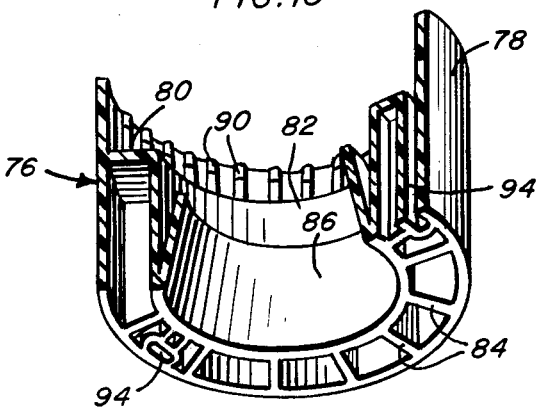
FIG. 15 is a cross-sectional perspective view of the projectile support.
Figure 16:
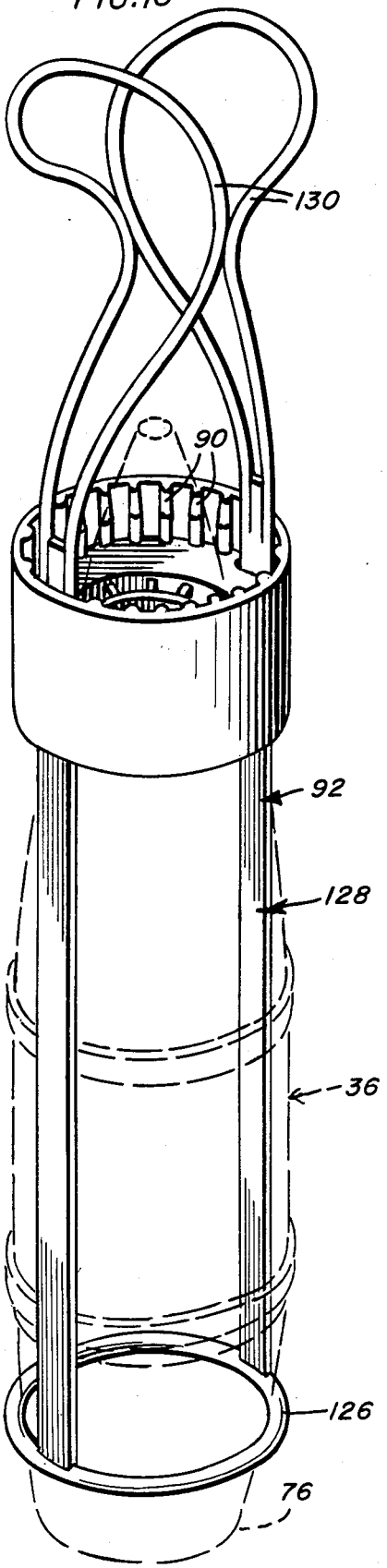
FIG. 16 is a perspective view of the projectile carrier and projectile support interrelated in projectile carrying orientation.
Figure 17:
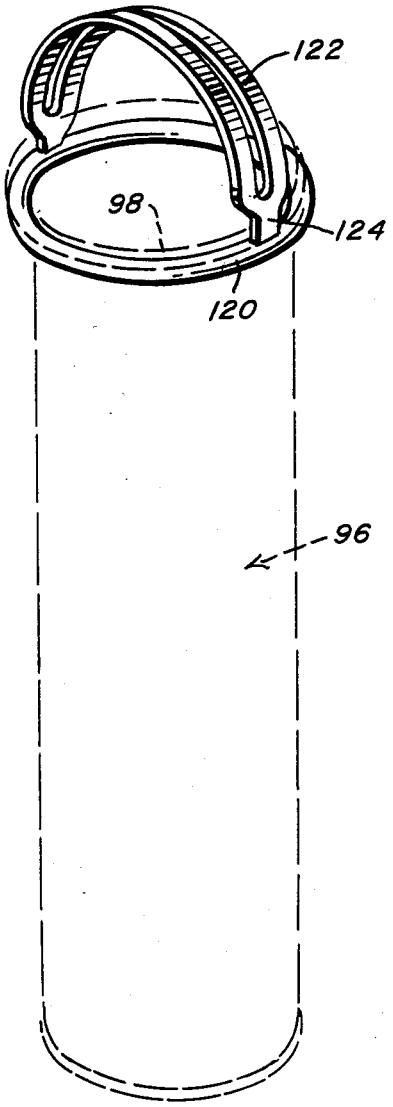
FIG. 17 is a perspective view of the carrying position of a case carrier with the case illustrated in phantom lines.

Noting FIG. 3, the connectors 124 and handle 122 flare slightly outward to extend beyond the open end 30 of the tubular housing 26 for ready engagement of the handle 122 upon removal of the cap 24. The collar 120 seats immediately inward of the case base 98 and acts as a centering and stabilizing means for and at the base end of the case 96.

The handle 122, or more particularly the two opposed semi-circular portions or bales thereof to the opposite sides of the connectors 124 fold outwardly to define an easily grasped handle for facilitating a direct outward drawing of the case 96 from the housing 26, as well as a convenient carrying means for the withdrawn case. As desired, the case carrier 118 can be easily removed from the case by a forward sliding thereof toward and beyond the plug-closed mouth end of the case.

The aforementioned projectile carrier 92 includes a collar or ring 126 within which the slightly tapered base end 72 of the projectile 36 seats. Noting FIG. 3, the carrier ring or collar 126 will be positioned forward of the housing seat 34 so as to not interfere with the snug reception of the base portion 72 of the projectile within the seat 34.

The carrier 92 includes a pair of elongate straps 128 integral with diametrically opposed portions of the collar 126 and of a length to project substantially forward of the collar received projectile 36. The forward portions of the straps 128 terminate in elongate relatively wide handle loops 130. The loops 130 are flexible and received through the opposed passages 94 in the projectile support 76 as the support 76 is moved inwardly into engagement with the forward portion 74 of the projectile 36. As desired, the handle loops 130 may include a resilient memory whereby, upon passing through the passages 94, the handle loops will tend to expand outwardly and thus retain the annular support inward of the loops 130 and in engagement with the projectile.

As will be appreciated, the support 76, in addition to stabilizing the projectile within the container, forms the further important function of stabilizing the forward portion 74 of the projectile 36 relative to the carrier 92 both as the projectile is withdrawn from the tubular housing 26 and after the projectile has been withdrawn from the housing. Removal of the carrier 92 from the projectile 36, at the appropriate time, is easily effected by first forwardly withdrawing the support 76 from the side straps 128 with the handle loops 130 collapsing, and subsequently rearwardly removing the carrier collar 126 from the base portion 72 of the projectile 36.

Referring now more specifically to the cap 24, the cap includes a top or outer panel 132 having an integral peripheral internally threaded skirt 134 removably threaded on the threaded forward portion or neck 38 of the tubular housing 26. The skirt 134 of the cap 24 includes series of longitudinally extending gripping grooves 136 closely spaced peripherally thereabout. The diameter of the skirt is generally equal to that of the cap-seating disc or plate 40 for flush engagement therewith. A plurality of apertured lugs 138 are integrally formed with the cap skirt 134 and project outwardly at spaced points about the open end of the skirt for the selective reception of a sealing wire therethrough and through the corresponding apertures 66 in the webs 64 between the plate 40 and front wall 50 of the adjacent stacking block 44. Such wire seals are particularly desired to preclude unauthorized access to the containers and provide a tamper-evident means for immediately visually indicating possible unauthorized access.

The top or front panel 132 of the cap includes four gripping lugs 140 positioned in spaced arcuate relation to each other. It is contemplated that an appropriate valve or valving port 142 be provided through the cap 24, possibly in the front panel or one of the lugs 140, as a means for both pressurizing and checking internal pressure within the container, it being contemplated that a slight positive pressure be maintained to assist in long term preservation. In addition, the top panel 132, which is solid and pressure retaining, is provided with a plurality of transparent viewing windows 144 therethrough, preferably one located between each pair of lugs 140.

Integral with the inner surface of the top panel 132, and inward of the lugs and viewing windows, is an annular flange 146, rigidified by radially extending ribs 148. A planar indicia ring 150 surrounds the flange 146 in outwardly spaced relation thereto and in underlying relation to the viewing windows 144. Appropriate informational indicia, identifying the contents of the container 20, for example as containing one of any number of different types of projectiles including high explosive, anti-tank, phosphorus, chemical, etc. will be provided on the face of the indicia ring 150 immediately underlying the windows 144. It is preferred that the indicia ring 150 be rotatably adjustable whereby multiple indicia can be provided thereon and selectively displayed in accord with the contents of the container 20. As such, the inner periphery of the indicia ring 150 is provided with a series of peripherally spaced notches 152 therein which, upon rotation of the ring, align with rearwardly directed fingers 154 integral with the cap front panel 132. In order to selectively rearwardly move the indicia ring to disengage the fingers 154 from the sockets or notches 152, the indicia ring is provided with an annular rearwardly directed gripping flange 156 in radial outwardly spaced relation about the notched inner periphery of the indicia ring 150.

A retaining collar 158 is used to retain the indicia ring 150 and is of an angular cross-sectional configuration with one leg 160 thereof surrounding the cap flange 146 in frictional engagement therewith immediately inward of the inner periphery of the indicia ring 150. The second leg 162 of the retaining collar 158 extends radially outward to the annular gripping flange 156 of the indicia ring 150 in rearwardly spaced relation to the rear surface of the planar portion of the indicia ring 150 to define an annular chamber 164 containing appropriate compression spring means 166 engaged between the retaining collar 158 and the indicia ring 150. The compression spring means resiliently biases the indicia ring against the rear surface of the front panel 132 of the cap 24 with the fingers 154 engaged within selected ones of the positioning notches 152. The retaining collar 158 itself is frictionally engaged with the annular flange 146. Should a more positive interengagement be required between the retaining collar and the flange 146, appropriate bonding means can be provided therebetween.

In adjusting the indicia ring, after a loading of the container and prior to a mounting of the cap, the gripping ring or flange 156 of the indicia ring is grasped by the hand with the indicia ring moved rearwardly against the biasing force of the spring means 166 to disengage the fingers 154. The indicia ring is then rotated to display the appropriate informational indicia and subsequently released to reengage the fingers and rotatably fix the indicia ring for a presentation of the appropriate indicia through one or all of the windows 144. The cap 24 is then mounted on the container, sealing at the leading edge thereof by the O-ring seal 42, and locked on the container, preferably by an appropriate wire tamper-evident seal engaged through the apertured cap lugs 138 and the web apertures 66.

As will be appreciated, the projectile 36 and case 96 are disassembled when stored within the container and in fact positioned "head-to-head". In positioning the various components within the container, the projectile carrier 92 is engaged with the projectile 36, as is the projectile support 76 with the straps 128 of the carrier 92, and in particular the handle loops 130 thereof, engaged through the support passages 94. The combination of components can then be introduced into the tubular housing 26 with the base portion 72 of the projectile 36 engaging within the housing seat 34. The shell case 96, normally with multiple charge bags therein, has the open end thereof closed by the plug 102 and the case carrier 118 mounted thereon at the case base 98. The case is then slid into the housing 26 into reception about the ogive of the projectile 36 and within the forward portion of the projectile support 76, seating on the shoulder 80. Assembled in this manner, it will be appreciated that the inner end of the case 96 tends to intimately engage the support 76 about the leading portion 74 of the projectile. At the same time, engagement of the support with the case plug 102 tends to firmly retain the plug within the case. The assembly is completed by a mounting of the cap 24 with the retaining collar 158, as well as the free edges of the cap flange 146 and indicia ring flange 156 seating against the base 98 of the case 96 in a manner which effects a positive inward retention of the case 96 and simultaneously precludes any possibility of accidental misalignment or rotation of the indicia ring 150. As will be appreciated from FIG. 3, the handle 122 of the case carrier 118 projects outwardly of the case base 98 immediately outward of the indicia ring flange 156 for easy access thereto upon removal of the cap 24.

While reference has been made to the sequential introduction of the components into the tubular housing 26, it will be appreciated that the interengagement between the projectile support and the case plug 102 particularly lends itself to a preassembly of all of the components and a simultaneous inward sliding thereof into the housing chamber 28.

In removing the shell components at the time of use, the cap 24, which is easily accessible even when the containers are palletized or otherwise stacked and strapped or secured, is screwed off the threaded leading end portion 38. The manipulation of the cap 24 is facilitated both by the grooved exterior thereof and by the multiple projecting lugs 140. The provision of the lugs is particularly significant in allowing for a positive grasping and manipulation of the cap 24 under adverse conditions, including, as an example, while wearing arctic mittens. With the cap removed, the opposed portions of the handle 122 are easily gripped for a forward pivoting thereof and an outward sliding of the case 96. The two bales forming the handle 122 provide a very convenient means for the carrying of the case from the storage area to the point of actual use. In fact, the loop arrangement of the handle should enable the simultaneous carrying of several cases.

The charge or propellant within the case 96 is normally provided in several separate bags, allowing immediate on site varying of the charge, as desired, by merely pulling out the case plug 102 and removing such bags as required. The plug can then be reinserted until assembly of the shell or cartridge is desired, or the projectile 36 can be mounted as soon as the proper charge has been provided. The manipulation of the plug 102 is easily effected through the enlarged finger grips 112, even with gloved hands.

After removal of the case 96 from the container, the handle loops 130 of the projectile carrier 92 are easily accessible through the same open end 30 through which the case was removed. Upon grasping the handle loops 130, the projectile 36 is forwardly drawn from the chamber 28 with the forward portion 74 of the projectile stabilized relative to the projectile carrier 92 by the projectile support 76. As with the case carrier 118, the enlarged handle loops 130 enable one to easily carry one or more projectiles from the storage area to the point of use. The projectile support 76, in addition to positioning, cushioning and protecting the projectile within the housing, also ensures a positive stabilization of the projectile 36 within the carrier 92. At the point of use, the support 76 and carrier 92 can be easily slid from the projectile, which in turn is then inserted into the open end of the corresponding casing 96. It will be appreciated that both carriers 92 and 118 are provided with relatively large loop-type handles. This, as suggested, is significant in facilitating the carrying of multiple components in a single hand, even while running. In addition, the handles are such as to allow for an easy grasping thereof even while wearing arctic mittens or being otherwise encumbered. The enlarged finger grips 110 of the case plug 102 are similarly adapted for an easy grasping thereof and manipulation of the plug, in addition to their specific positioning to accommodate the ogive of the projectile 36 therebetween.

It is contemplated that the container, as well as the support, plug and cap, be molded of high density polyethylene, while the carriers can be formed of molded low density polyethylene. As desired, to accommodate design differences between shells, interchangeable projectile supports can be provided wherein the projectile engaging inner tapered wall 86 can be varied to ensure proper engagement with the particular projectile packaged.

The container system of the invention is particularly adapted to be stacked or palletized with the container cap and the stored components accessible and easily removed from one end of the container. The container cap specifically provides for identification of the contents of the container, a pressurization and pressure test port, lugs to accommodate a tamper-evident seal, and means for facilitating a manual gripping and removal of the cap without the necessity of the use of special tools.

While the container accommodates both the projectile and the case therefor, the components are not assembled in the container, but rather are individually removable therefrom through the use of mounted carriers which facilitate both the removal and carrying of the components until such time as an actual assembly of the components is required. The stabilizing elements of the storage system, including the projectile support and the case plug, each perform additional functions. For example, the support provides a stabilizing means for the projectile within the associated carrier when removed from the container, and the plug providing for selective access to the interior of the case for changing the charge.

What is claimed is:

1. For use in storing a projectile and case, said projectile having a base end and a leading end portion, said case having a base and projectile-receiving open end; a shell container system comprising an elongate housing having an elongate chamber longitudinally therein, said chamber being defined by a peripheral wall and having a closed inner end and an open outer end, a cap removably mounted over said open outer end for selectively closing said chamber, a projectile seat within said chamber adjacent the closed inner end for receiving and seating the base end of a chamber-received projectile, a projectile support slidably positioned within said chamber for engagement about the leading end portion of the chamber-received projectile, said projectile support having an outer peripheral wall slidably engaging the peripheral wall of said chamber for a centering of the support therein, said support having an inner annular periphery including a portion configured to engage and surround the leading end portion of the projectile, and a projectile carrier for the projectile slidably positioned within said chamber, said projectile carrier including a projectile engaging member for engaging and supporting the projectile at the base end thereof, said projectile carrier including elongate strap means extending forwardly from the projectile engaging member to generally parallel and project beyond the leading end portion of the projectile, said projectile support including passage means receiving said strap means therethrough for stabilizing the projectile relative to said strap means, said strap means projecting forwardly of said projectile support and terminating in a handle, the inner annular periphery of said projectile support including a recessed shoulder forwardly directed toward the open outer end of the chamber for receiving and seating the open end of a chamber-received case positioned with the base end thereof at the open outer end of the chamber, a case plug slidably receivable within the open end of the chamber-received case for engagement therewith on the recessed shoulder of said projectile support.

2. The container system of claim 1 wherein the shoulder within the projectile support is annular for extension of the forward portion of the leading end portion of the projectile therethrough and therebeyond, said case plug defining a rearward opening compartment for receiving and enclosing the forward portion of the leading end portion of the projectile.

3. The container system of claim 2 wherein the elongate strap means of the projectile carrier is adapted to extend along at least a portion of the length of the chamber-received case immediately adjacent thereto.

4. The container system of claim 3 including a case carrier having a case engaging member for engaging the chamber-received case at the base of the case within the chamber and between the case and the peripheral wall of the chamber, said case carrier including handle means selectively foldable between a collapsed position immediately adjacent the open end of the chamber, for enclosure therein by the container cap, and an outwardly directed handling position.

5. The container system of claim 4 wherein said cap includes a top panel having transparent window means therethrough, a peripheral skirt extending rearwardly from said cap top panel for sealed locking engagement with the elongate housing, an information indicia member within said cap skirt and in rearward underlying relation to said top panel, and means mounting said indicia member for adjustment relative to said top panel for selective exposure of information indicia through said window means, said top panel and skirt defining a rearwardly directed opening, said cap confining said indicia member for access thereto solely through the rearwardly directed opening prior to locking engagement of the cap with said housing.

6. The container system of claim 4 wherein the case engaging member of said case carrier comprises an annular collar, said handle means comprising a pair of semi-circular bales positioned in opposed coplanar relation in the collapsed position of said handle means, and connector means connecting said bales to said annular collar at diametrically opposed points thereon for selective pivotal movement to the outwardly directed handling position.

7. The container system of claim 2 wherein said case plug includes a front wall with an annular skirt integral with the periphery thereof and extending rearwardly therefrom, and finger grip means intergral with said plug front wall and extending rearwardly thereof in radial inward spaced relation to said plug skirt, said finger grip means being adapted to centrally receive the forward portion of the leading end portion of the projectile.

8. The container system of claim 1 wherein said elongate housing is cylindrical and includes an outer surface with longitudinally extending peripherally spaced reinforcing ribs integral therewith, and a plurality of stacking blocks formed about said cylindrical housing at spaced points along the length thereof, said stacking blocks presenting planar stacking surfaces for a stacking abutment with the blocks of adjacent housings, and means on said stacking blocks for selectively interlocking adjacent stacked housings.

9. The container system of claim 8 wherein each of said stacking blocks is square and comprises plural planar walls laterally spaced from each other lengthwise of the cylindrical housing and interconnected by transverse webs, said block walls and said webs being integrally formed with said housing and projecting radially outward thereof peripherally thereabout, said block walls defining said planar stacking surfaces, including a top wall, a bottom wall, and opposed side faces.

10. The container system of claim 9 wherein said means for interlocking adjacent stacked housings includes lugs integrally formed with the top wall of each stacking block and projecting vertically therefrom, and cooperating recesses defined in the corresponding bottom wall of each stacking block for the nested reception of the top wall lugs.

11. The container system of claim 1 wherein said projectile support includes an inner annular wall extending from said shoulder radially spaced from and coaxial with the outer peripheral wall of said support, the inner annular periphery of the support configured to engage and surround the leading end portion of the projectile comprising an annular seat integral with the coaxial inner wall at the end thereof remote from the annular shoulder, said annular seat extending toward said annular shoulder and inclined radially inward relative to the inner wall of the support to define a generally conical configuration for conformance to the leading end portion of the projectile.

12. The container system of claim 11 wherein said passage means comprises a pair of elongate passages defined through the support immediately inward of the outer peripheral wall at a pair of diametrically opposed portions thereof, each of said passages, along a major portion of the length thereof, being defined by a surrounding wall for a stabilized confinement of the strap means therein.

13. The container system of claim 1 including a case carrier having a case engaging member for engaging a chamber-received case at the base thereof and handle means selectively foldable between a collapsed position immediately adjacent the open end of the chamber, for enclosure therein by the container cap, and an outwardly directed handling position, the case engaging member of said case carrier comprising an annular collar, said handle means comprising a pair of semi-circular bales positioned in opposed coplanar relation in the collapsed position of said handle means, and connector means connecting said bales to said annular collar at diametrically opposed points thereon for selective pivotal movement to the outwardly directed handling position.

14. The container system of claim 1 wherein said cap includes a top panel having transparent window means therethrough, a peripheral skirt extending rearwardly from said cap top panel for sealed locking engagement with the elongate housing, an information indicia member within said cap skirt and in rearward underlying relation to said top panel, and means mounting said indicia member for adjustment relative to said top panel for selective exposure of the information indicia through said window means, said top panel and skirt defining a rearwardly directed opening, said cap confining said indicia member for access thereto solely through the rearwardly directed opening prior to locking engagement of the cap with said housing.

15. The container system of claim 14 wherein said indicia bearing member comprises a planar ring, a retaining ring engaged with said top panel about said indicia ring, spring means resiliently engaged between said retaining ring and said indicia ring for biasing said indicia ring against the top panel of the cap and allowing for manual retraction of said indicia ring from said top panel for rotation relative thereto, and positioning means on said top panel and indicia ring for fixing said indicia ring relative to said top panel at adjusted positions of said indicia ring relative to said top panel.

16. The container system of claim 15 wherein the top panel of said cap includes a plurality of spaced forwardly projecting gripping lugs, and valving means for the selective introduction and periodic checking of internal pressure within the elongate housing.

17. For use in the storing of a shell projectile and case, said projectile having a base end and a leading end portion, said case having a base and a projectile-receiving open end; a shell container system comprising an elongate housing having an elongate chamber longitudinally therein, said chamber being defined by a peripheral wall and having a closed inner end and an open outer end, a cap removably mounted to the housing over the open outer end of said chamber for a selective closing of said chamber, a projectile support slidably positioned within said chamber for engagement about the leading end portion of a chamber-received projectile, said projectile support having an outer peripheral wall slidably engaging the peripheral wall of the chamber for a centering of the support therein, said support having an inner annular periphery including a portion configured to engage and surround the leading end portion of the projectile, said inner annular periphery of the support including a recessed shoulder forwardly directed toward the open outer end of the chamber, a case plus slidably receivable within the open end of chamber-received case, said case plug being slidably received within said projectile support and seated on said recessed shoulder, said case plug defining a rearwardly opening compartment for reception and enclosure of the forward portion of the leading end portion of the projectile, a projectile carrier received within said chamber inward of said projectile support for engagement with said projectile, said projectile carrier projecting forwardly of said support and including handle means for a forward drawing of said projectile carrier and the projectile therewith, and a case carrier received within said chamber at the open outer end thereof, said case carrier including forwardly directed handle means retained within the mounted cap forward of the open end of the chamber.

18. The container system of claim 17 wherein said projectile carrier includes an annular collar receivable about the base portion of a projectile, and a pair of elongate straps fixed to said collar at diametrically opposed portions and extending forwardly therefrom, each of said straps terminating in an enlarged loop defining the handle means of the projectile carrier, said projectile support including a pair of diametrically opposed passages therethrough longitudinally of said elongate chamber, said projectile carrier straps extending through said support passages and cooperating therewith in stabilizing said projectile within said projectile carrier.

19. The container system of claim 18 wherein said case carrier includes an annular collar engageable about the case at the base end thereof, said case carrier collar engaging within the chamber between the case and the peripheral wall of the chamber immediately inward of the open outer end of the chamber, said case carrier handle means comprising a pair of semi-circular handle bales positioned in coplanar spaced overlying relation to said case carrier collar immediately outward of the open outer end of said chamber, and integral connector means connecting said handle bales to said case collar for a selective outward pivoting of the handle bales to define a case handle.

20. The container system of claim 17 wherein said case plug a top panel with a peripheral projecting skirt defining a rearwardly opening compartment for receiving and enclosing the forward portion of the leading end portion of the projectile, and a pair of finger grips rigid with and extending from said top panel, radially inward of said skirt, for reception of the forward portion of the projectile therebetween.

21. The container system of claim 20 wherein said cap includes a top panel having transparent window means therethrough, a peripheral skirt extending rearwardly from said cap for sealed locking engagement with the elongate housing, an information indicia member within said cap skirt and in rearward underlying relation to said top panel, and means mounting said indicia member for adjustment relative to said top panel for selective exposure of information indicia through said window means, said top panel and skirt defining a rearwardly directed opening, said cap confining said indicia member for access thereto solely through the rearwardly directed opening prior to locking engagement of the cap with said housing.

22. The container system of claim 21 wherein said indicia member comprises a planar ring, a retaining ring engaged with said top panel about said indicia ring, spring means resiliently engaged between said retaining ring and said indicia ring for biasing said indicia ring against the top panel of the cap and allowing for manual retraction of said indicia ring from said top panel for rotation relative thereto, and positioning means on said top panel and indicia ring for fixing said indicia ring relative to said top panel at adjusted positions of said indicia ring relative to said top panel.

23. The container system of claim 17 wherein said cap includes a top panel having transparent window means therethrough, a peripheral skirt extending rearwardly from said cap for sealed locking engagement with the elongate housing, an information indicia member within said cap skirt and in rearward underlying relation to said top panel, and means mounting said indicia member for adjustment relative to said top panel for selective exposure of information indicia through said window means, said top panel and skirt defining a rearwardly directed opening, said cap confining said indicia member for access thereto solely through the rearwardly directed opening prior to locking engagement of the cap with said housing.

24. The container system of claim 23, wherein said indicia bearing member comprises a planar ring, a retaining ring engaged with said top panel about said indicia ring, spring means resiliently engaged between said retaining ring and said indicia ring for biasing said indicia ring against the top panel of the cap and allowing for manual retraction of said indicia ring from said top panel for rotation relative thereto, and positioning means on said top panel and indicia ring for fixing said indicia ring relative to said top panel at adjusted positions of said indicia ring relative to said top panel.

25. The container system of claim 17 wherein said case plug includes a top panel with a peripheral projecting skirt defining a rearwardly opening compartment for receiving and enclosing the forward portion of the leading end portion of the projectile, and a pair of finger grips rigid with and extending from said top panel, radially inward of said skirt, for reception of the forward portion of the projectile therebetween.

26. The container system of claim 17 wherein said elongate housing is cylindrical and includes an outer surface with longitudinally extending peripherally spaced reinforcing ribs integral therewith, and a plurality of stacking blocks formed about said cylindrical housing at spaced points along the length thereof, said stacking blocks presenting planar stacking surfaces for a stacking abutment of adjacent housings, and means on said stacking blocks for selectively interlocking adjacent stacked housings.

27. A projectile carrier comprising an annular ring engageable about the base portion of a projectile, a pair of elongate straps extending in laterally spaced parallel relation to each other from diametrically opposed portions of said ring, said straps terminating in enlarged loop handles, and means slidably received on said straps adjacent said loop handles for maintaining said straps in laterally spaced parallel relation and confining the forward portion of a projectile therebetween.

28. The projectile carrier of claim 27 wherein said means comprises an annular projectile support having an inner annular seat for receiving and seating the leading portion of a projectile, and a pair of diametrically opposed passages radially outward of said seat receiving said straps longitudinally therethrough.

29. A case plug for the selective closing of the open mouth of a shell case prior to assembly with a projectile and for the retention of the charge therein, said case plug comprising a front wall, an annular skirt extending peripherally from said front wall, and a pair of laterally spaced finger grips integral with said front wall and radially inward of said skirt, said front wall, between said finger grips, being outwardly formed, relative to the opposite side of said front wall, to define a compartment aligned between said finger grips.

30. A cap for selective locking engagement with a housing, said cap including a top panel having transparent window means therethrough, a peripheral skirt extending rearwardly from said cap top panel for sealed locking engagement with the housing, an information indicia member within said cap skirt and in rearward underlying relation to said top panel, and means mounting said indicia member for adjustment relative to said top panel for selective exposure of the information indicia through said window means, said top panel and skirt defining a rearwardly directed opening, said cap confining said indicia member for access thereto solely through the rearwardly directed opening prior to locking engagement of the cap with said housing, said indicia bearing member comprising a planar ring, a retaining ring engaged with said top panel about said indicia ring, spring means resiliently engaged between said retaining ring and said indicia ring for biasing said indicia ring against the top panel of the cap and allowing for manual retraction of said indicia ring from said top panel for rotation relative thereto, and positioning means on said top panel and indicia ring for fixing said indicia ring relative to said top panel at adjusted positions of said indicia ring relative to said top panel.

* * * * *